United States Patent [19]

Spinner

[11] Patent Number: 4,745,244

[45] Date of Patent: May 17, 1988

[54] HF-SWITCH

[76] Inventor: Georg Spinner, Am Eichberg 12, 8152 Feldkirchen, Fed. Rep. of Germany

[21] Appl. No.: 41,816

[22] Filed: Apr. 22, 1987

[30] Foreign Application Priority Data

Apr. 22, 1986 [DE] Fed. Rep. of Germany ..... 3613608

[51] Int. Cl.[4] ..... H01H 1/46

[52] U.S. Cl. ..... 200/258; 200/254; 200/279

[58] Field of Search ..... 200/279, 283, 258, 254, 200/257, 159 A; 333/262

[56] References Cited

U.S. PATENT DOCUMENTS

| | | | |
|---|---|---|---|
| 2,115,069 | 4/1938 | Hall | 200/258 |
| 3,054,879 | 9/1962 | Soreng | 200/159 B |
| 3,288,949 | 11/1966 | Brown, Jr. | 200/258 |
| 3,676,629 | 7/1972 | Evans, et al. | 200/254 |

FOREIGN PATENT DOCUMENTS

| | | |
|---|---|---|
| 1888255 | 2/1964 | Fed. Rep. of Germany . |
| 1978683 | 2/1968 | Fed. Rep. of Germany . |
| 1938777 | 2/1971 | Fed. Rep. of Germany . |
| 1960597 | 6/1971 | Fed. Rep. of Germany . |
| 3,202,139 | 12/1983 | Fed. Rep. of Germany . |

*Primary Examiner*—Renee S. Luebke

*Attorney, Agent, or Firm*—Henry M. Feiereisen

[57] ABSTRACT

A HF-switch includes a contact set which comprises a bifurcated contact piece cooperating with a contact blade. The contact piece includes a pair of contact springs supported at their one end and provided with opposing contact rivets at their other end between which the contact blade is movable within a predetermined tolerance range. The contact rivets are of circular cone shape and are defined by a height which corresponds at least to half the permissible tolerance range of the contact blade and by a base angle $\alpha \leqq 45°$.

6 Claims, 1 Drawing Sheet

HF-SWITCH

FIELD OF THE INVENTION

The present invention is concerned with a switch, in particular a high frequency (HF)-switch.

BACKGROUND OF THE INVENTION

HF-switches of the concerned type include a bifurcated contact piece having a pair of contact springs fixed at one end and supporting at the other end respective contact rivets which face each other and between which a contact blade is movable.

In such HF-switches, the contact rivets are usually of cylindrical shape with rounded cap which defines the contacting area. In addition, contact rivets of semicircular (semispherical) shape are known. The contact blade is inserted between the contact rivets of the bifurcated contact piece by respectively moving or twisting the blade. Depending on the thickness of the contact blade, the contact springs are prestressed in opposite direction in order to exert the required contact force for providing the desired contact with the contact blade.

These HF-switches have drawbacks, especially when the contact blade is not exactly positioned in the central plane of the bifurcated contact piece. In case of cylindrical contact rivets but also in case of semispherical contact rivets especially when larger positional deviations of the control blade are concerned, the control blade runs on one of the rivets thereby deforming the contact spring or damaging the contact rivet. This in turn leads to a poor contact and increased contact resistance which may result in a fusing of the contacts especially when considerable power is transmitted and may even lead to a destruction of the entire switch because of overheating.

Although in a HF-switch with one contact set consisting of bifurcated contact piece and contact blade, this problem may be overcome by narrow tolerances of the contact set and by wear resisting support of the contact blade, difficulties are still encountered when electrically connecting a number of such contact sets in parallel arrangement and in the event the pertaining bifurcated contact pieces, on the one hand, and the contact blade, on the other hand, are combined to one integral unit as is usually the case e.g. in the coaxial switches for high HF-powers.

SUMMARY OF THE INVENTION

It is an object of the present invention to provide an improved HF-switch obviating the afore-stated drawbacks.

This object and others which will become apparent hereinafter are attained in accordance with the present invention by providing the contact rivets in a direction perpendicular to the plane of the contact springs as circular cone with a height corresponding at least to half the positional tolerance range of the contact blade and with a base angle equal to or smaller than 45°.

Through the provision of such a HF-switch, a secure contacting between the contact piece and the contact blade is achieved even when relatively high tolerances are concerned i.e. when the contact blade extends parallel at considerable distance to the central plane of the contact piece. Moreover, in case the contact blade is slightly tilted, the knife edge running on the respective contact rivet will not cause an upsetting or compression as the contact rivet slides along the knife edge and is laterally deflected.

In comparison to known contact rivets of e.g. cylindrical shape and of corresponding mass, the contact rivets according to the invention have the advantage of an improved heat removal because of the larger base area.

According to a further feature of the invention, the contact blade has a knife edge defined by an angle which is equal to or smaller than the base angle of the contact rivets. Through this teaching, a secure sliding of the contact rivets along the knife edge is guaranteed.

In order to provide the contact rivets with sufficient contact force when the contact blade extends offset i.e. at a distance to the central plane of the contact piece, the contact springs are prestressed in opposite direction by an additional spring deflection in correspondence to half the positional tolerance range of the contact blade.

Preferably, the contact rivets as well as the knife edge of the contact blade are provided with rounded tips of relatively small radius.

BRIEF DESCRIPTION OF THE DRAWING

The above and other objects, features and advantages of the present invention will now be described in more detail with reference to the accompanying drawings in which.

DESCRIPTION OF PREFERRED EMBODIMENTS

Figure 1:
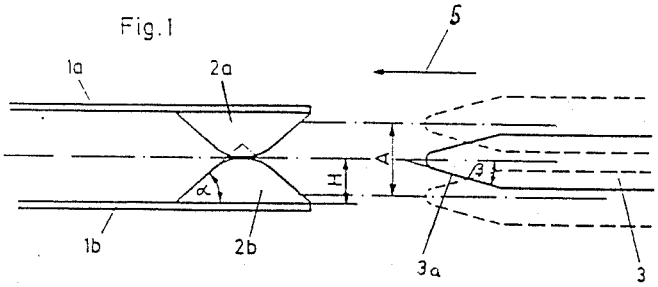
FIG. 1 is a side view of one embodiment of a contact piece in accordance with the present invention and in cooperation with a contact blade shown in various positions within a permitted tolerance range.

In the drawings, there is shown a bifurcated contact piece of an otherwise not shown HF-switch and including a pair of contact springs 1*a*, 1*b* which at their free end are provided with respectively opposing contact rivets 2*a*, 2*b*. Cooperating with the contact piece is a contact blade 3 which is movable from right to left as indicated by arrow 5 and is insertable between the rivets 2*a*, 2*b* for contacting. In FIG. 1, the contact blade 3 is shown in various positions as permitted by the given tolerance range A of the contact springs 1*a*, 1*b*. The desired position is indicated in continuous line while the respective limit positions are indicated by broken lines.

Both contact rivets 2*a*, 2*b* are of circular cone shape with a base angle $\alpha \leqq 45°$ and a round tip of small radius, and with a height $H \geqq A/2$. The contact blade 3 has a knife edge 3*a* including a rounded tip of small radius e.g. smaller than the radius of the tip of the rivets 2*a*, 2*b* and being defined by a blade angle $\beta \leqq \alpha$.

Figure 2:
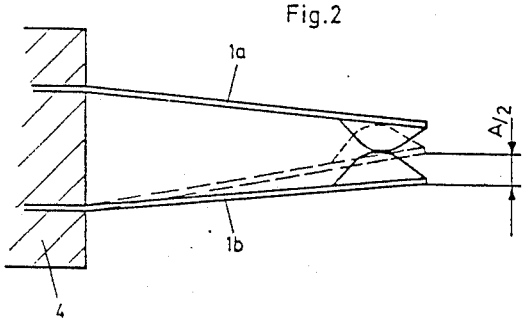
FIG. 2 is a side view of the contact piece fixed in a support and suitably prestressed.

Turning now to FIG. 2, it can be seen that the contact springs 1*a*, 1*b* are retained with their end remote from the rivets 2*a*, 2*b* in a support 4 and are prestressed in an opposite direction. In dependence on the tolerance range A, the springs 1*a*, 1*b* are prestressed in such a manner that a sufficient contact force is exerted onto the contact blade 3 by each spring 1*a*, 1*b* when being deflected by half the tolerance range A, as indicated by broken line in FIG. 2. Thus, the contact springs 1*a*, 1*b* are prestressed towards each other in a direction perpendicular to the plane of the contact springs 1*a*, 1*b* by an additional spring deflection which substantially equals half the tolerance range A of the contact blade 3.

Figure 3:
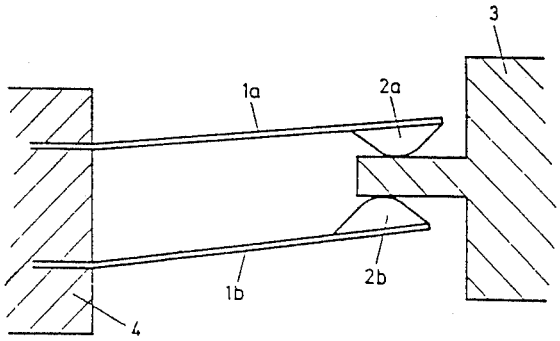
FIGS. 3 and 4 are each a side view of the contact piece in cooperation with the contact blade occupying its respectively tolerated limit position.
Figure 4:
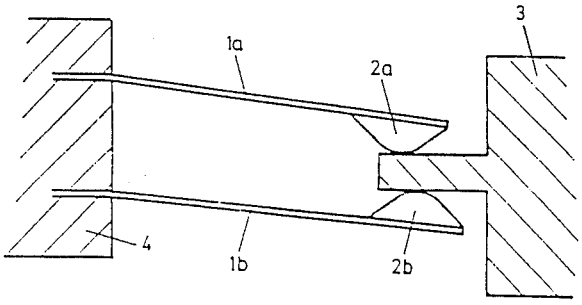

In FIGS. 3 and 4, the contact blade 3 is shown in its maximal tolerated limit positions and guided in a direction perpendicular to the plane of projection with its knife edge arranged between the rivets *2a, 2b*. A secure contacting between the rivets *2a, 2b* and the contact blade 3 is achieved even when the latter is not in its desired position but in either of the limit positions or in any intermediate position because one of the contact rivets i.e. rivet *2a* in FIG. 3 or rivet *2b* in FIG. 4 moves approximately perpendicular to the central plane of the bifurcated contact piece while the other contact rivet i.e. rivet *2b* in FIG. 3 or rivet *2a* in FIG. 4 follows at a sufficient contact force in correspondence with the prestress of the pertaining contact spring *1a* or *1b*.

While the invention has been illustrated and described as embodied in a HF-Switch, it is not intended to be limited to the details shown since various modifications and structural changes may be made without departing in any way from the spirit of the present invention.

What is claimed as new and desired to be protected by Letters Patent is set forth in the appended claims:

I claim:

1. A switch, comprising:

a contact piece including at least two contact springs supported at one end and provided with opposing contact rivets at their other end; and a contact blade movable in a direction between said contact rivets within a predetermined tolerance range, said contact rivets extending perpendicular to the direction of movement of said contact blade and being of circular cone shape with a height of at least half the tolerance range of said contact blade and with a base angle which is equal to or smaller than 45°, wherein said contact springs are prestressed toward each other in a direction perpendicular to the direction of movement of said contact blade by a spring deflection which substantially corresponds to half the tolerance range of said contact blade.

2. A switch as defined in claim 1 wherein said contact blade is defined by a blade angle which is equal to or smaller than the base angle of said contact rivets.

3. A switch as defined in claim 1 wherein each of said contact rivets has a rounded tip of small radius.

4. A switch as defined in claim 1 wherein said contact blade has a rounded tip of small radius.

5. A switch as defined in claim 1 wherein each of said contact rivets has a rounded tip of small radius and said contact blade has a rounded tip of small radius, the radius of said contact blade being smaller than the radius of said contact rivets.

6. A switch, comprising:

a contact piece including at least two contact springs supported at one end and provided with opposing contact rivets at their other end; and a contact blade movable in a direction between said contact rivets within a predetermined tolerance range, said contact rivets extending perpendicular to the direction of movement of said contact blade and being of circular cone shape with a height of at least half the tolerance range of said contact blade and with a base angle which is equal to or smaller than 45°, wherein said contact springs are prestressed toward each other in a direction perpendicular to the direction of movement of said contact blade by a spring deflection which substantially corresponds to half the tolerance range of said contact blade.

* * * * *